US012643008B1

(12) United States Patent
Tsai

(10) Patent No.: US 12,643,008 B1
(45) Date of Patent: Jun. 2, 2026

(54) FOLDABLE LEG LIFT MACHINE

(71) Applicant: Yu-Lun Tsai, Taichung City (TW)

(72) Inventor: Yu-Lun Tsai, Taichung City (TW)

( * ) Notice: Subject to any disclaimer, the term of this patent is extended or adjusted under 35 U.S.C. 154(b) by 45 days.

(21) Appl. No.: 19/012,798

(22) Filed: Jan. 7, 2025

Related U.S. Application Data

(63) Continuation-in-part of application No. 18/390,328, filed on Dec. 20, 2023, now Pat. No. 12,337,203.

(51) Int. Cl.

| | |
|---|---|
| ***A63B 21/00*** | (2006.01) |
| ***A63B 21/008*** | (2006.01) |
| ***A63B 22/00*** | (2006.01) |
| ***A63B 23/035*** | (2006.01) |
| ***A63B 23/04*** | (2006.01) |

(52) U.S. Cl.
CPC ..... *A63B 22/0056* (2013.01); *A63B 21/0083* (2013.01); *A63B 21/4034* (2015.10); *A63B 21/4035* (2015.10); *A63B 22/001* (2013.01)

(58) Field of Classification Search
CPC ..... A63B 21/00185; A63B 21/159; A63B 21/4034; A63B 21/4035; A63B 23/03591; A63B 23/04; A63B 23/0482; A63B 21/0615; A63B 21/0628; A63B 21/4033; A63B 21/4039; A63B 23/0222; A63B 2208/0233
See application file for complete search history.

(56) References Cited

U.S. PATENT DOCUMENTS

| | | | | | |
|---|---|---|---|---|---|
| 4,477,071 | A * | 10/1984 | Brown | A63B 22/0076 | 482/73 |
| 5,411,458 | A * | 5/1995 | Giust | A63B 21/154 | 482/142 |
| 5,569,138 | A * | 10/1996 | Wang | A63B 23/03533 | 482/130 |
| 5,743,832 | A * | 4/1998 | Sands | A63B 21/4031 | 482/52 |
| 5,938,575 | A * | 8/1999 | Stearns | A63B 23/0211 | 482/142 |
| 6,120,416 | A * | 9/2000 | Walker | A63B 21/159 | 482/52 |
| 7,104,934 | B1 * | 9/2006 | Smith | A63B 23/16 | 482/44 |
| 8,152,698 | B1 * | 4/2012 | Chen | A63B 23/04 | 482/53 |
| 9,375,599 | B1 * | 6/2016 | Simmons | A63B 21/00047 | |
| 9,498,696 | B1 * | 11/2016 | Razon | A63B 22/0046 | |
| 9,504,873 | B2 * | 11/2016 | Yeh | A63B 21/4035 | |
| 9,895,574 | B2 * | 2/2018 | Gejdos | A63B 21/4047 | |

(Continued)

*Primary Examiner* — Garrett K Atkinson
(74) *Attorney, Agent, or Firm* — LANWAY IPR SERVICES; Chun-Ming Shih

(57) ABSTRACT

A foldable leg lift machine includes a base unit, a main handle unit, two drive levers, two pedals, and a linkage mechanism. The base unit includes a first stand, a second stand pivotally connected with the first stand, and two third stands pivotally connected with the first stand. The main handle unit is connected with the first stand and provided with a handgrip. Each of the drive levers is pivotally connected with one of the third stands. Each of the pedals is pivotally connected with one of the drive levers. The linkage mechanism includes a swing base pivotally mounted on the third stands, and two linkage rods each pivotally connected with the swing base and pivotally connected with one of the two drive levers.

9 Claims, 9 Drawing Sheets

(56) References Cited

U.S. PATENT DOCUMENTS

| | | | | |
|---|---|---|---|---|
| 11,110,318 | B2 * | 9/2021 | Lo | A63B 22/0664 |
| 2007/0287619 | A1 * | 12/2007 | Tuller | A63B 21/4047 482/123 |
| 2008/0039298 | A1 * | 2/2008 | Steinmetz | A63B 21/4047 482/101 |
| 2008/0254951 | A1 * | 10/2008 | Chu | A63B 21/068 482/96 |
| 2009/0176633 | A1 * | 7/2009 | Dlugopolskiy | A63B 21/4047 482/100 |
| 2012/0058866 | A1 * | 3/2012 | Hongo | A63B 21/068 482/131 |
| 2012/0277069 | A1 * | 11/2012 | Hockridge | A63B 21/159 482/139 |
| 2015/0367162 | A1 * | 12/2015 | Mueller | A63B 21/154 482/94 |
| 2016/0001126 | A1 * | 1/2016 | Yeh | A63B 23/1263 482/92 |
| 2017/0225029 | A1 * | 8/2017 | Lin | A63B 21/00181 |
| 2017/0304677 | A1 * | 10/2017 | Clinton | A63B 21/4047 |
| 2018/0001131 | A1 * | 1/2018 | Nevarez, Jr. | A63B 21/068 |
| 2018/0326242 | A1 * | 11/2018 | Jaquish | A63B 21/00069 |
| 2019/0015695 | A1 * | 1/2019 | Simmons | A63B 21/4047 |
| 2019/0175982 | A1 * | 6/2019 | Gearon | A63B 21/4035 |
| 2021/0045955 | A1 * | 2/2021 | Marti | A63B 21/00185 |
| 2022/0305332 | A1 * | 9/2022 | Chang | A63B 21/00181 |
| 2025/0090898 | A1 * | 3/2025 | Ellis | A63B 22/205 |

* cited by examiner

FOLDABLE LEG LIFT MACHINE

CROSS-REFERENCES TO RELATED APPLICATIONS

The present invention is a continuation-in-part (C.I.P.) application of the U.S. Ser. No. 18/390,328.

BACKGROUND OF THE INVENTION

Field of the Invention

The present invention relates to an exercising machine and, more particularly, to a leg lift (or raise or extension) machine.

Description of the Related Art

A conventional leg lift machine generally comprises a base, a front handlebar rack, a rear bracket, a driving mechanism, a magnetically controlled resistance mechanism, and a linkage mechanism. The driving mechanism includes two driving levers. Each of the driving levers has a first end swingably connected to the rear bracket and a second end pivotally connected with a pedal. The driving mechanism further includes sprockets and chains mounted between the rear bracket and the driving levers. The magnetically controlled resistance mechanism is driven by the sprockets in a one-way direction to produce a resistance. The linkage mechanism is connected with the driving levers so that the driving levers swing in two opposite directions.

However, the conventional leg lift machine has the following disadvantages.

1. The sprockets and the chains are expensive and increase the cost of production. In addition, it takes much time to adjust the sprockets and the chains so that the sprockets and the chains are rotated smoothly.

2. The magnetically controlled resistance mechanism at least includes magnetically controlled components, rotating wheels, and belts (or chains), resulting in high cost of fabrication and production.

3. The conventional leg lift machine has a complicated construction with many parts so that the conventional leg lift machine is not assembled easily, thereby increasing the cost of assembly.

4. The conventional leg lift machine takes up a large space and cannot be folded for storage.

BRIEF SUMMARY OF THE INVENTION

The primary objective of the present invention is to provide a foldable leg lift machine that is partially collapsed when not in use.

In accordance with the present invention, there is provided a leg lift machine comprising a base unit, a main handle unit, two drive levers, two pedals, and a linkage mechanism. The base unit includes a first stand, a second stand, two third stands, a first transverse rod, and a second transverse rod. The first transverse rod is placed on the ground. The second transverse rod is placed on the ground. The first stand has a lower end secured to the first transverse rod. The second stand has a lower end secured to the second transverse rod. The second stand has an upper end foldably and pivotally connected with a middle position of the first stand. The two third stands are arranged at two sides of the first stand. Each of the two third stands has an upper end foldably and pivotally connected with an upper end of the first stand. Each of the two third stands has a lower end provided with a support member arranged transversely. The main handle unit has a lower end securely connected with a front section of the first stand. The main handle unit has an upper end provided with a handgrip. Each of the two drive levers has an upper end pivotally connected with one of the two third stands and served as a rotation fulcrum. The two drive levers reciprocally swing forward and backward and move along a curved trajectory. Each of the two pedals is pivotally connected with a lower end of one of the two drive levers. The linkage mechanism includes a swing base and two linkage rods. The swing base is pivotally mounted on the two third stands and symmetrically swings leftward and rightward. Each of the two linkage rods has a lower end pivotally connected with one of two ends of the swing base. Each of the two linkage rods has an upper end pivotally connected with the upper end of one of the two drive levers. The two drive levers are limited by the swing base and the two linkage rods to reciprocally swing forward and backward. The linkage mechanism further includes two resistance telescopic cylinders. Each of the two resistance telescopic cylinders has an upper end pivotally connected with one of the two ends of the swing base and a lower end mounted on a fixed member which is secured on the support member.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
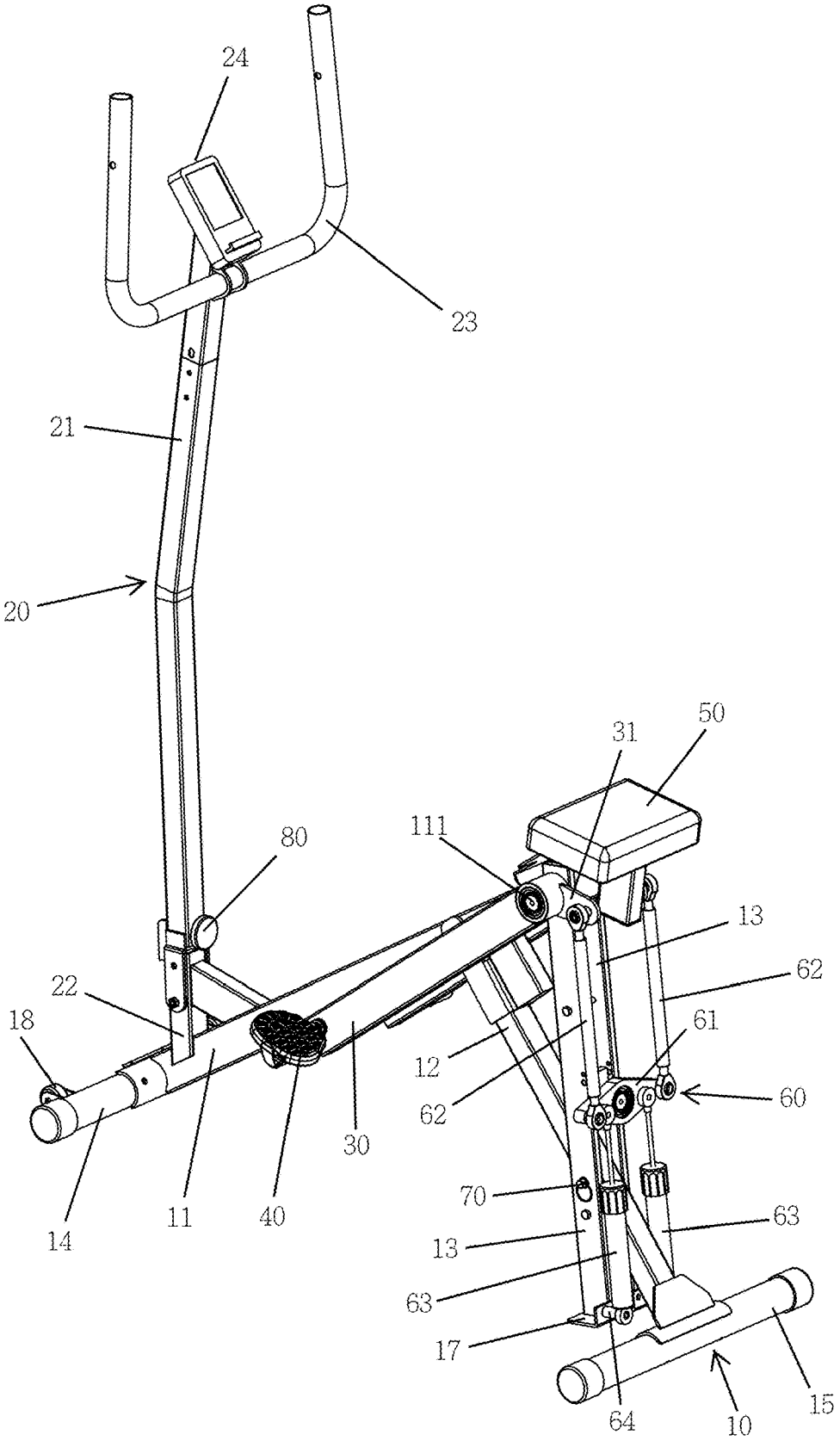
FIG. 1 is a perspective view of a leg lift machine in accordance with the first preferred embodiment of the present invention.

Referring to the drawings and initially to FIGS. 1-5, a foldable leg lift machine in accordance with the preferred embodiment of the present invention comprises a base unit 10, a main handle unit 20, two drive levers 30, two pedals 40, and a linkage mechanism 60.

The base unit 10 includes a first stand (or support) 11, a second stand (or support) 12, two third stands (or supports) 13, a first transverse rod 14, and a second transverse rod 15. The first transverse rod 14 is placed on the ground. The second transverse rod 15 is placed on the ground. The first stand 11 has a lower end secured to the first transverse rod 14. The second stand 12 has a lower end secured to the second transverse rod 15. The second stand 12 has an upper end foldably and pivotally connected with a middle position of the first stand 11. The two third stands 13 are arranged at two sides of the first stand 11. Each of the two third stands 13 has an upper end foldably and pivotally connected with an upper end of the first stand 11. Each of the two third stands 13 has a lower end provided with a support member 17 arranged transversely. The lower end of each of the two third stands 13 is placed on the ground. Two rollers 18 are pivotally mounted on the first transverse rod 14.

The main handle unit 20 has a lower end securely connected with a front section of the first stand 11. The main handle unit 20 has an upper end provided with a handgrip 23.

Each of the two drive levers 30 has an upper end pivotally connected with one of the two third stands 13 and served as a rotation fulcrum. The two drive levers 30 reciprocally (or alternatingly) swing forward and backward and move along a curved trajectory (or track).

Each of the two pedals 40 is pivotally connected with a lower end of one of the two drive levers 30.

The linkage mechanism 60 includes a swing base 61 and two linkage rods 62. The swing base 61 is pivotally mounted on the two third stands 13 and symmetrically swings leftward and rightward. Each of the two linkage rods 62 has a lower end pivotally connected with one of two ends of the swing base 61. Each of the two linkage rods 62 has an upper end pivotally connected with the upper end of one of the two drive levers 30. Thus, the two drive levers 30 are limited by the swing base 61 and the two linkage rods 62 to reciprocally swing forward and backward.

The linkage mechanism 60 further includes two resistance telescopic cylinders 63. Each of the two resistance telescopic cylinders 63 has an upper end pivotally connected with one of the two ends of the swing base 61 and a lower end mounted on a fixed member 64 which is secured on the support member 17.

In the preferred embodiment of the present invention, a shaft 111 extends through the first stand 11, the two third stands 13, and the two drive levers 30, so that the first stand 11, the two third stands 13, and the two drive levers 30 are pivotally connected by the shaft 111.

In the preferred embodiment of the present invention, the second stand 12 passes between the two third stands 13. A fastening pin 70 extends through the second stand 12 and the two third stands 13 so that the second stand 12 and the two third stands 13 are fixed mutually by the fastening pin 70.

In the preferred embodiment of the present invention, a seat 50 is mounted on the first stand 11. The seat 50 is close to the upper end of the first stand 11.

In the preferred embodiment of the present invention, the main handle unit 20 includes an upper support 21 and a lower support 22. The upper support 21 has a lower end foldably and pivotally connected with an upper end of the lower support 22. A fastening pin 80 extends through the upper support 21 and the lower support 22 so that the upper support 21 and the lower support 22 are fixed mutually by the fastening pin 80. The handgrip 23 is secured to an upper end of the upper support 21. The lower support 22 has a lower end securely connected with the front section of the first stand 11.

In the preferred embodiment of the present invention, the main handle unit 20 has a top provided with a control panel 24. The control panel 24 is secured on the upper support 21.

In the preferred embodiment of the present invention, the base unit 10 further includes a fixed member 16 secured between the two third stands 13. The swing base 61 has a center pivotally mounted on the fixed member 16 and symmetrically swings leftward and rightward relative to the fixed member 16.

In the preferred embodiment of the present invention, the upper end of each of the two drive levers 30 is provided with a first pivot ear 31, and the upper end of each of the two linkage rods 62 is pivotally connected with the first pivot ear 31 of one of the two drive levers 30.

Figure 2:
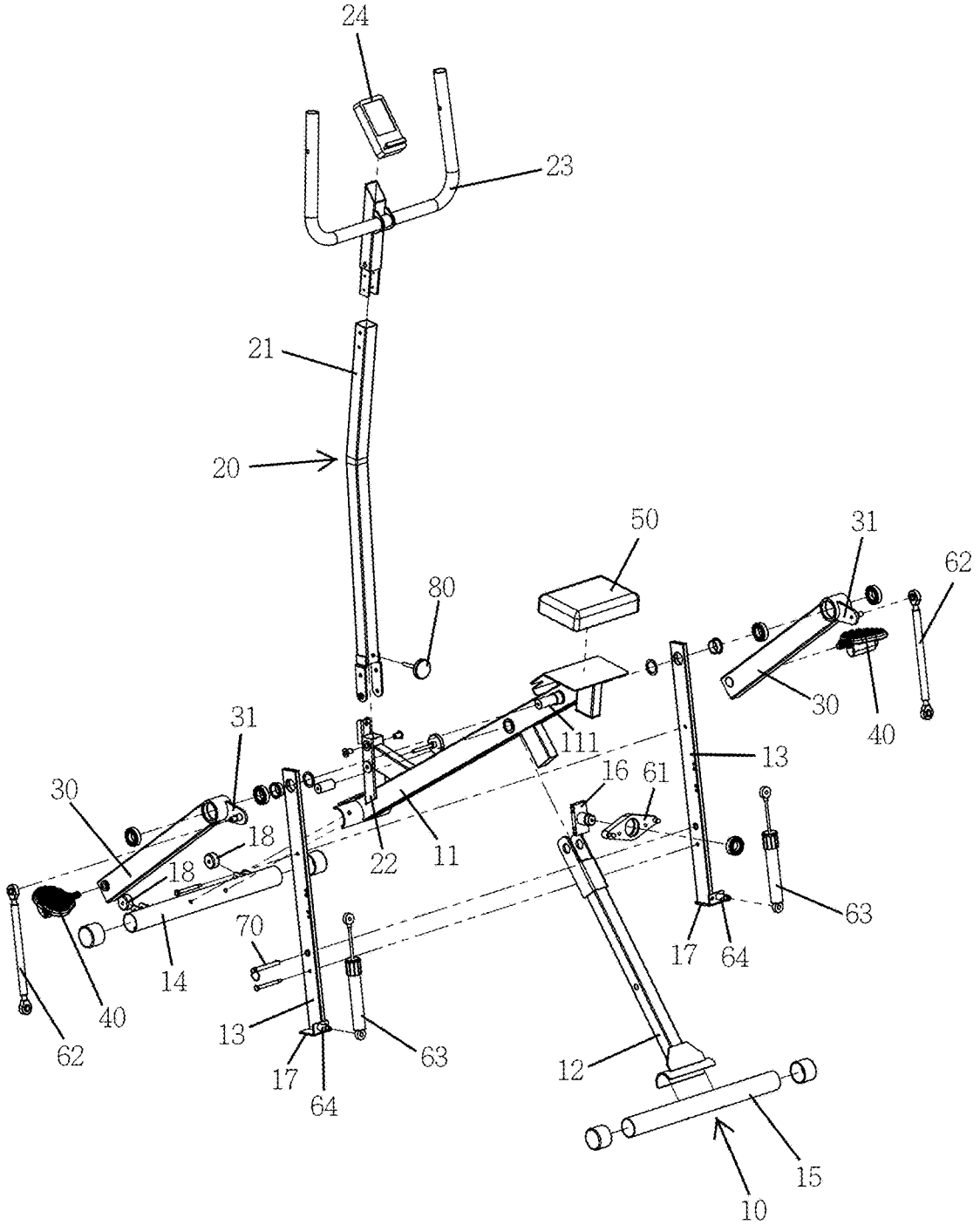
FIG. 2 is an exploded perspective view of the leg lift machine as shown in FIG. 1.
Figure 3:
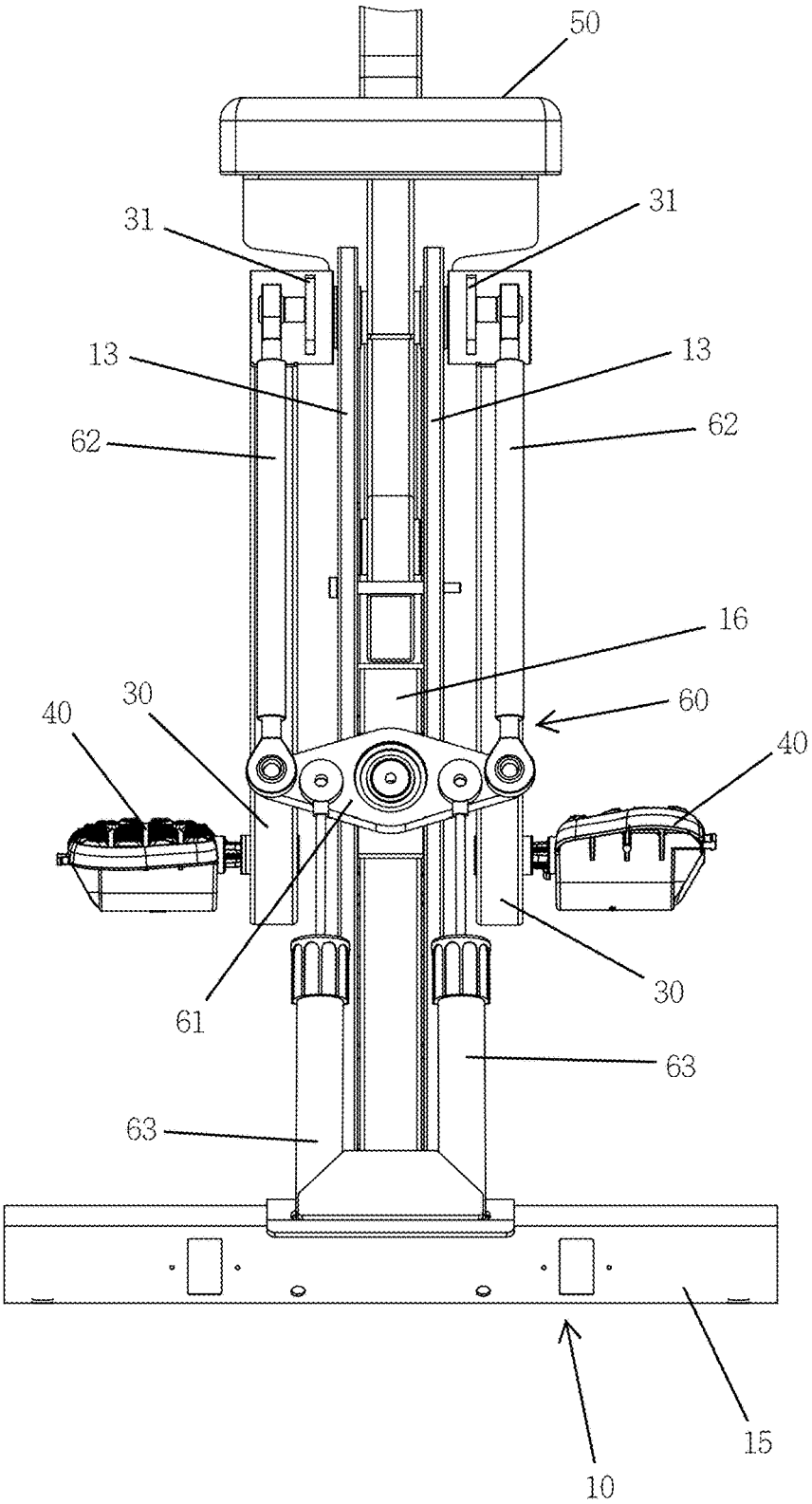
FIG. 3 is a rear view of the leg lift machine as shown in FIG. 1.
Figure 4:
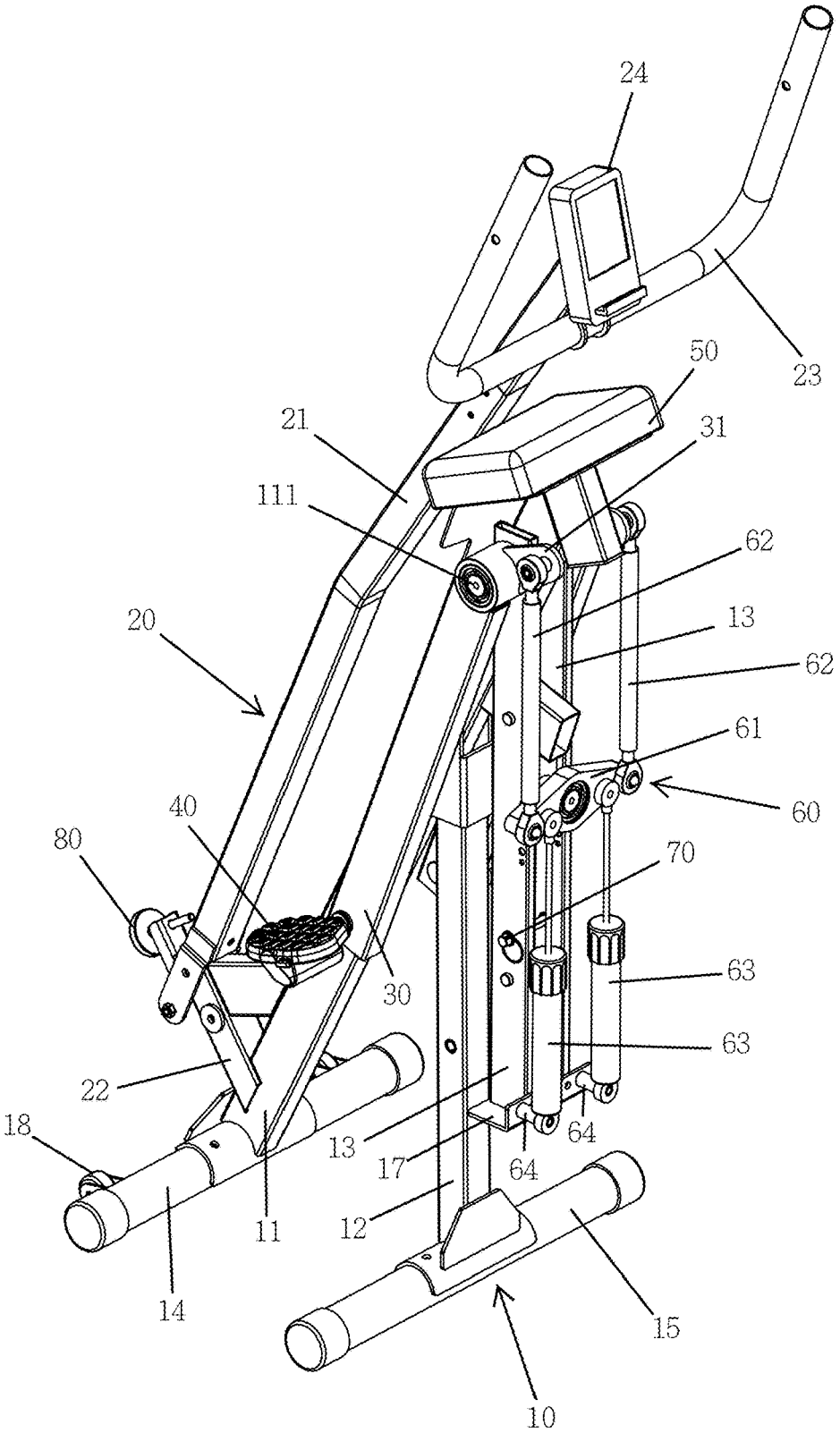
FIG. 4 is a side operational view of the leg lift machine as shown in FIG. 1.

In operation, referring to FIG. 4 with reference to FIGS. 1-3, the user sits on the seat 50, with his/her two hands holding the handgrip 23 and two feet treading the two pedals 40. In such a manner, the linkage mechanism 60 mounted on the two third stands 13 is driven to symmetrically swing leftward and rightward so that the two drive levers 30 are limited by the linkage mechanism 60 to reciprocally swing or pivot forward and backward. Thus, the user can raise legs to achieve an exercising effect. In addition, the two resistance telescopic cylinders 63 provide a resistance to the user.

Figure 5:
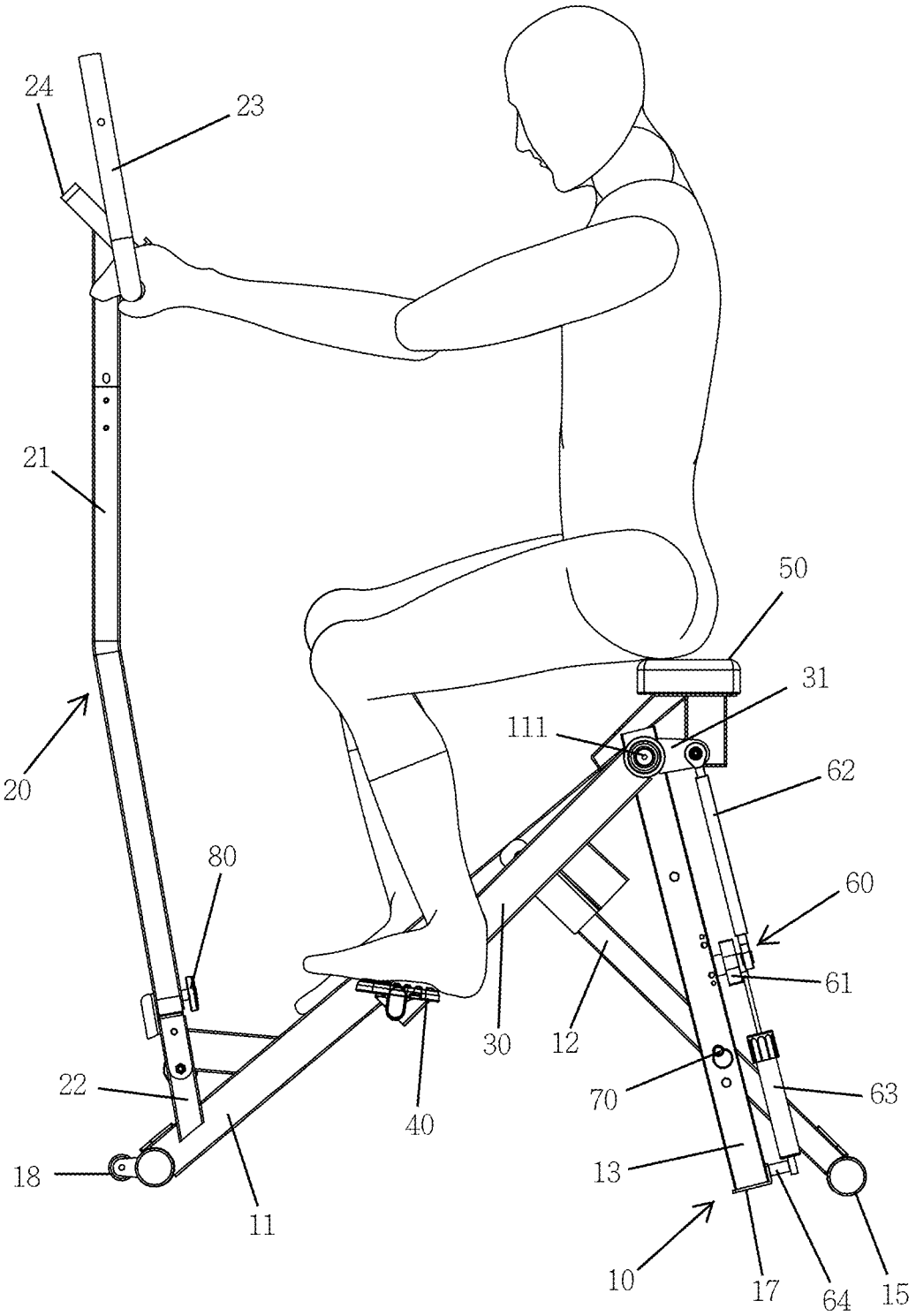
FIG. 5 is a folded view of the leg lift machine as shown in FIG. 1.

In folding of the leg lift machine, referring to FIG. 5 with reference to FIGS. 1-3, the fastening pin 70 is detached from the second stand 12 and the two third stands 13 so that the second stand 12 and the two third stands 13 are unlocked. In addition, the fastening pin 80 is detached from the upper support 21 and the lower support 22 so that the upper support 21 and the lower support 22 are unlocked. In such a manner, the first stand 11, the second stand 12, the two third stands 13, the upper support 21, and the lower support 22 are folded mutually.

Referring to FIGS. 6-9, the leg lift machine in accordance with another preferred embodiment of the present invention further comprises two secondary handle units 90 pivotally mounted on two sides of the base unit 10. The upper end of each of the two drive levers 30 is provided with a second pivot ear 32. Each of the two secondary handle units 90 includes a first linking member 91, a second linking member 92, and a third linking member 93. The first linking member 91 has a lower end pivotally connected with the main handle unit 20. The second linking member 92 has an upper end connected with the lower end of the first linking member 91. An angle is defined between the first linking member 91 and the second linking member 92. The third linking member 93 has a front end pivotally connected with a lower end of the second linking member 92. The third linking member 93 has a rear end pivotally connected with the second pivot ear 32 of one of the two drive levers 30.

Figure 6:
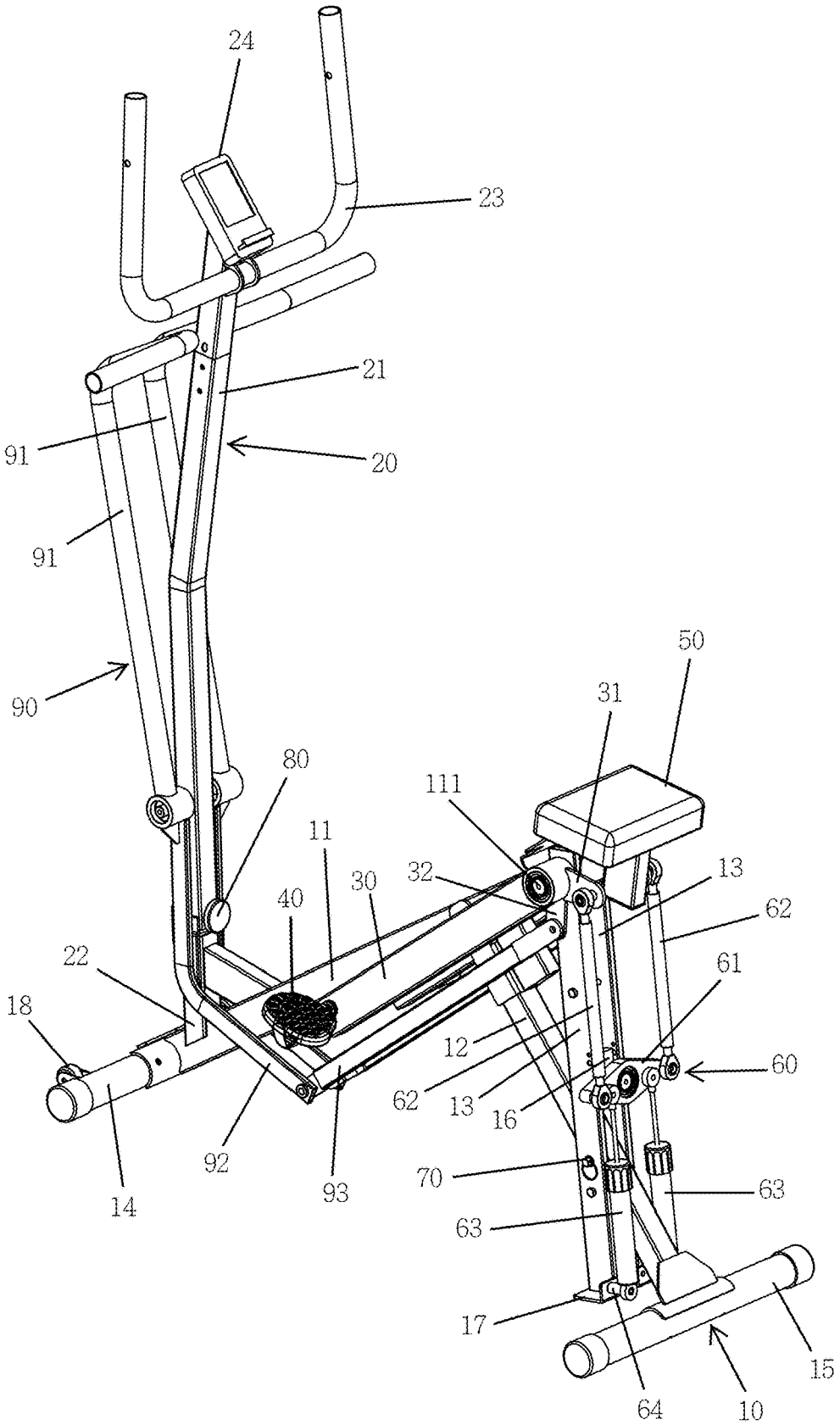
FIG. 6 is a perspective view of a leg lift machine in accordance with the second preferred embodiment of the present invention.
Figure 7:
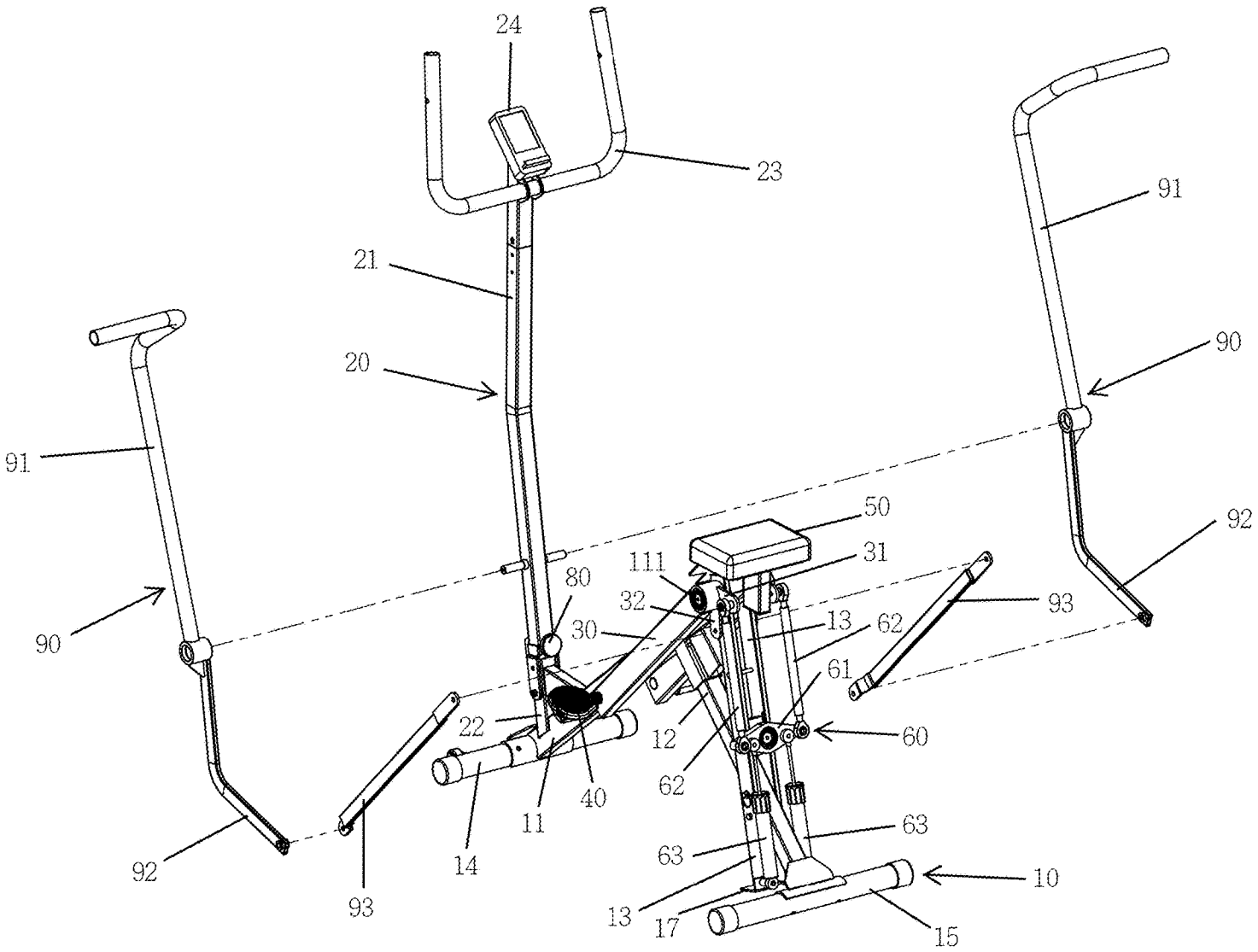
FIG. 7 is an exploded perspective view of the leg lift machine as shown in FIG. 6.
Figure 8:
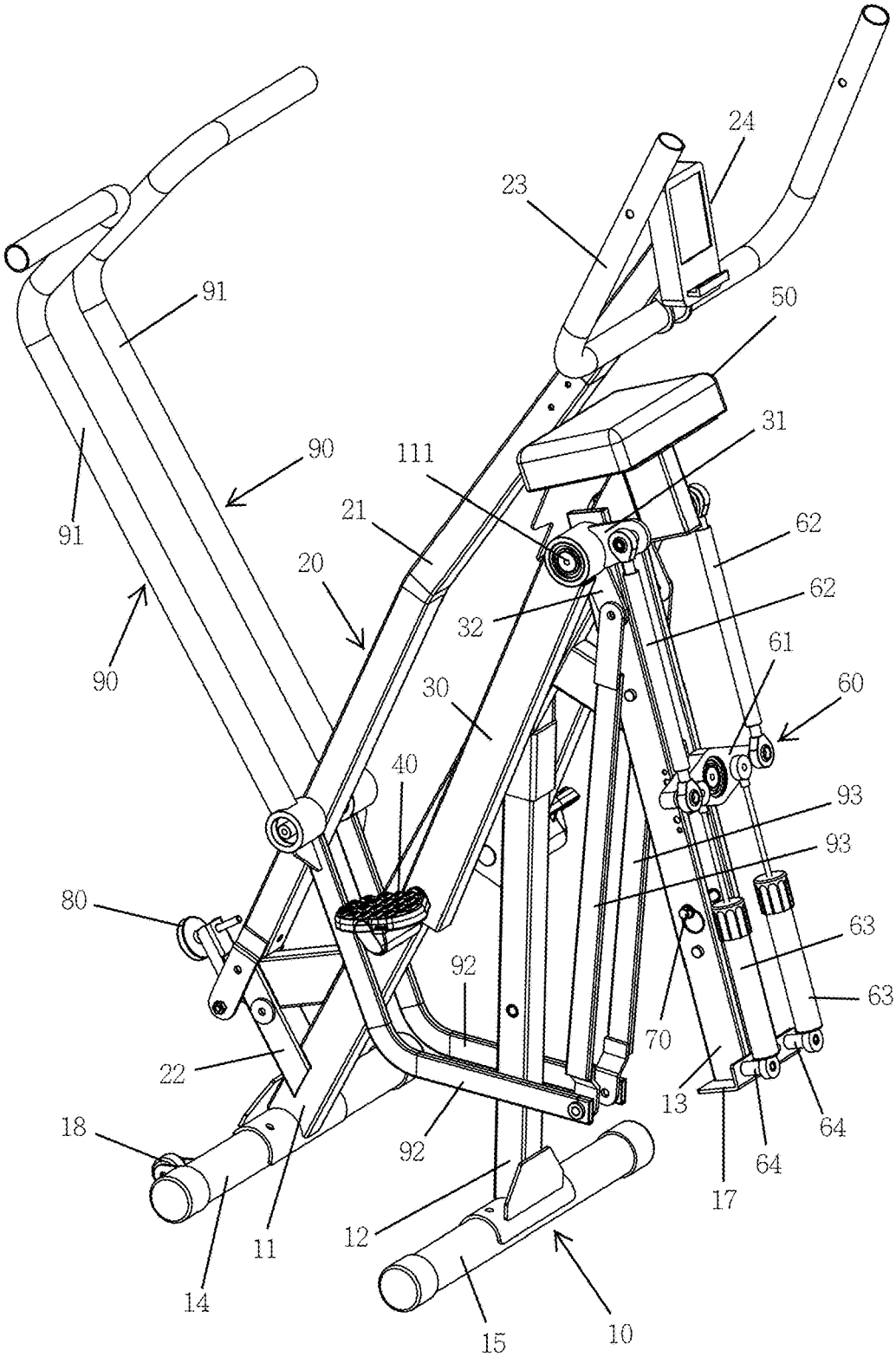
FIG. 8 is a side operational view of the leg lift machine as shown in FIG. 6.

In operation, referring to FIG. 8 with reference to FIGS. 6 and 7, the two secondary handle units 90 are arranged on two sides of the base unit 10. When the user's two hands hold the first linking member 91 of each of the two secondary handle units 90, the third linking member 93 of each of the two secondary handle units 90 is driven by the second pivot ear 32 of one of the two drive levers 30, so that the two secondary handle units 90 are pivoted and swing in concert with the two drive levers 30. Thus, the user can exercise legs and hands simultaneously. In addition, the two resistance telescopic cylinders 63 provide a resistance to the user.

Figure 9:
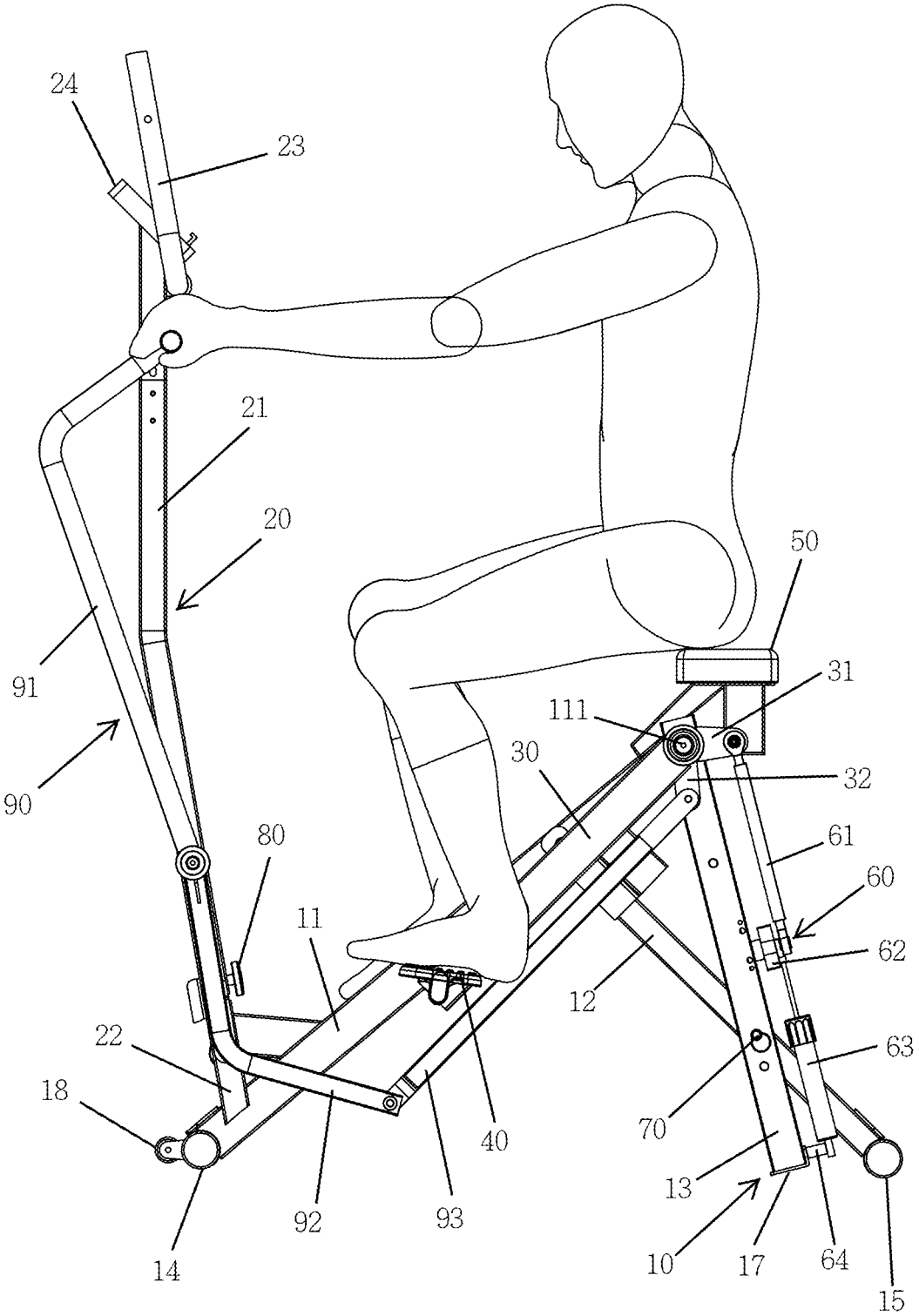
FIG. 9 is a folded view of the leg lift machine as shown in FIG. 6.

In folding of the leg lift machine, referring to FIG. 9 with reference to FIGS. 6-8, the fastening pin 70 is detached from the second stand 12 and the two third stands 13 so that the second stand 12 and the two third stands 13 are unlocked. In addition, the fastening pin 80 is detached from the upper support 21 and the lower support 22 so that the upper support 21 and the lower support 22 are unlocked. In such a manner, the first stand 11, the second stand 12, the two third stands 13, the upper support 21, and the lower support 22 are folded mutually.

Accordingly, the leg lift machine of the present invention has the following advantages.

1. The leg lift machine use an interactive leg raising movement to effectively stretch the user's hips, knees, ankle joints, and to stretch core muscles such as the abdominal and buttock muscles. In addition, the two resistance telescopic cylinders 63 provide a resistance to the user.

2. The user's hands reciprocatingly sway and move forward and backward, to stretch the forearms, upper arms, triceps and other muscle groups. In addition, the two resistance telescopic cylinders 63 provide a resistance to the user.

3. The leg lift machine does not have complicated magnetic resistance mechanisms and linkage mechanisms, to decrease the cost of fabrication and production. In addition, the leg lift machine is assembled easily and quickly.

4. With reference to FIGS. 4 and 8, the first stand 11, the second stand 12, the two third stands 13, the upper support 21, and the lower support 22 are folded after the fastening pin 70 and the fastening pin 80 are removed, to facilitate storage, packaging, and transportation of the leg lift machine. In addition, the leg lift machine is folded easily and quickly to decrease the whole volume so that the leg lift machine is stored easily and does not take up much space.

5. The two resistance telescopic cylinders 63 provide a resistance to the user when the two drive levers 30 are moved and when the two secondary handle units 90 are moved, so that the user's body is trained more effectively and significantly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A leg lift machine comprising:

a base unit, a main handle unit, two drive levers, two pedals, and a linkage mechanism;

wherein:

the base unit includes a first stand, a second stand, two third stands, a first transverse rod, and a second transverse rod;

the first transverse rod is configured to be placed on the ground;

the second transverse rod is configured to be placed on the ground;

the first stand has a lower end secured to the first transverse rod;

the second stand has a lower end secured to the second transverse rod;

the second stand has an upper end foldably and pivotally connected with a middle position of the first stand;

the two third stands are arranged at two sides of the first stand;

each of the two third stands has an upper end foldably and pivotally connected with an upper end of the first stand;

each of the two third stands has a lower end provided with a support member arranged transversely;

the main handle unit has a lower end securely connected with a front section of the first stand;

the main handle unit has an upper end provided with a handgrip;

each of the two drive levers has an upper end pivotally connected with one of the two third stands and serves as a rotation fulcrum;

the two drive levers reciprocally swing forward and backward and move along a curved trajectory;

each of the two pedals is pivotally connected with a lower end of one of the two drive levers;

the linkage mechanism includes a swing base and two linkage rods;

the swing base is pivotally mounted on the two third stands and symmetrically swings leftward and rightward;

each of the two linkage rods has a lower end pivotally connected with one of two ends of the swing base;

each of the two linkage rods has an upper end pivotally connected with the upper end of one of the two drive levers;

the two drive levers are limited by the swing base and the two linkage rods to reciprocally swing forward and backward;

the linkage mechanism further includes two resistance telescopic cylinders; and each of the two resistance telescopic cylinders has an upper end pivotally connected with one of the two ends of the swing base and a lower end mounted on a fixed member which is secured on the support member.

2. The leg lift machine as claimed in claim 1, wherein a shaft extends through the first stand, the two third stands, and the two drive levers, so that the first stand, the two third stands, and the two drive levers are pivotally connected by the shaft.

3. The leg lift machine as claimed in claim 1, wherein the second stand passes between the two third stands, and a fastening pin extends through the second stand and the two third stands so that the second stand and the two third stands are fixed mutually by the fastening pin.

4. The leg lift machine as claimed in claim 1, wherein a seat is mounted on the first stand.

5. The leg lift machine as claimed in claim 1, wherein:

the main handle unit includes an upper support and a lower support;

the upper support has a lower end foldably and pivotally connected with an upper end of the lower support;

a fastening pin extends through the upper support and the lower support so that the upper support and the lower support are fixed mutually by the fastening pin;

the handgrip is secured to an upper end of the upper support; and the lower support has a lower end securely connected with the front section of the first stand.

6. The leg lift machine as claimed in claim 1, wherein the main handle unit has a top provided with a control panel, and two rollers are pivotally mounted on the first transverse rod.

7. The leg lift machine as claimed in claim 1, wherein the base unit further includes a fixed member secured between the two third stands, and the swing base has a center pivotally mounted on the fixed member and symmetrically swings leftward and rightward relative to the fixed member.

8. The leg lift machine as claimed in claim 1, wherein the upper end of each of the two drive levers is provided with a first pivot ear, and the upper end of each of the two linkage rods is pivotally connected with the first pivot ear of one of the two drive levers.

9. The leg lift machine as claimed in claim 1, further comprising:

two secondary handle units pivotally mounted on two sides of the base unit;

wherein:

the upper end of each of the two drive levers is provided with a second pivot ear;

each of the two secondary handle units includes a first linking member, a second linking member, and a third linking member;

the first linking member has a lower end pivotally connected with the main handle unit;

the second linking member has an upper end connected with the lower end of the first linking member;

an angle is defined between the first linking member and the second linking member;

the third linking member has a front end pivotally connected with a lower end of the second linking member; and the third linking member has a rear end pivotally connected with the second pivot ear of one of the two drive levers.

* * * * *